United States Patent [19]

Ehrlich

[11] 4,067,302

[45] Jan. 10, 1978

[54] TWO-STROKE INTERNAL COMBUSTION ENGINE AND METHOD OF OPERATION THEREOF

[75] Inventor: Josef Ehrlich, Ashridge, near Berkhemsted, England

[73] Assignee: Outboard Marine Corporation, Waukegan, Ill.

[21] Appl. No.: 659,736

[22] Filed: Feb. 20, 1976

Related U.S. Application Data

[63] Continuation-in-part of Ser. No. 579,808, May 22, 1975.

[51] Int. Cl.[2] ..... F02B 33/04

[52] U.S. Cl. ..... 123/73 AA; 123/73 A; 123/73 PP

[58] Field of Search ..... 123/73 R, 73 A, 73 AA, 123/73 PP, 74 R, 74 A

[56] References Cited

U.S. PATENT DOCUMENTS

| | | | |
|---|---|---|---|
| 980,134 | 12/1910 | Springer | 123/73 AA |
| 1,109,694 | 9/1914 | Mosier | 123/73 AA |
| 1,113,456 | 10/1914 | McIntosh | 123/73 AA |
| 1,115,481 | 11/1914 | Bachle et al. | 123/69 V |
| 1,126,308 | 1/1915 | Snyder | 123/73 AA |
| 1,483,619 | 2/1924 | Smith | 123/73 AA |
| 1,527,166 | 2/1925 | Bezv | 123/73 R |
| 2,966,900 | 1/1961 | Ehrlich | 123/73 AA |
| 3,107,659 | 10/1963 | Steinlein et al. | 123/73 R |
| 3,363,611 | 1/1968 | VonSeggern et al. | 123/73 R |

*Primary Examiner*—Ronald H. Lazarus
*Assistant Examiner*—David D. Reynolds
*Attorney, Agent, or Firm*—Michael, Best & Friedrich

[57] ABSTRACT

Disclosed herein is an internal combustion engine comprising a piston movable relative to a cylinder and a crankcase between top dead center and bottom dead center positions and relative to first, second and third positions respectively spaced from top dead center position at respectively greater distances, whereby the crankcase is subject to cyclical conditions of relatively high and low pressure, a transfer chamber, a reed valve controlled port for supplying fresh air to the transfer chamber when the transfer chamber is subject to low pressure, a carburetor for supplying a fuel/air mixture to the crankcase when the crankcase is subject to low pressure, a transfor port providing communication between the transfer chamber and the crankcase during conditions of low pressure in the crankcase and during piston travel between top dead center position and the first position whereby to cause introduction into the transfer chamber of fresh air, whereby the air introduced into the chamber is isolated during piston movement between the first and second positions, an inlet port providing communication between the transfer chamber and the cylinder during piston travel between the second position and bottom dead center, whereby the air introduced into the transfer chamber is permitted to flow from the transfer chamber into the cylinder, and a piston port cooperating with the transfer port to provide communication between the transfer chamber and the crankcase during conditions of relatively high pressure in the crankcase and during piston travel between the third position and bottom dead center position, whereby fuel/air mixture flows into the cylinder through the transfer chamber from the crankcase.

Also disclosed herein is the method of operating of the above described engine.

17 Claims, 5 Drawing Figures

TWO-STROKE INTERNAL COMBUSTION ENGINE AND METHOD OF OPERATION THEREOF

RELATED INVENTION

This application is a continuation-in-part application based on my earlier application Serial No. 579,808 filed May 22, 1975.

BACKGROUND OF INVENTION

The invention relates generally to internal combustion engines, and more particularly, to two-stroke piston-ported engines. Such engines have, in the past, commonly employed the incoming fuel/air mixture to scavenge the exhaust gases from the cylinder with the result that incoming charge was often, in part, discharged unburnt through the exhaust system in the atmosphere, thereby providing a pollution problem as well as adversely affecting fuel economy.

Disclosed in the Scott U.S. Pat. No. 968,200 issued Aug. 23, 1910, and in the Springer U.S. Pat. No. 980,134 issued Dec. 27, 1910, are two-stroke internal combustion engines in which scavenging air is sucked into a transfer passage and delivered from the transfer passage into the cylinder ahead of delivery of fuel/air mixture through the transfer passage from the crankcase.

Attention is also directed to the following United States Patents which disclose delivery of scavenging air to the cylinder prior to delivery to the cylinder of fuel/air mixture.

| | Patent | Issue Date |
|---|---|---|
| Brehm | 854,981 | May 28, 1907 |
| Easthope | 976,858 | November 29, 1910 |
| Bachle & Krebs | 1,115,481 | November 3,1914 |
| Deacon | 1,511,112 | October 7,1924 |
| Mansoff | 2,381,832 | August 7,1945 |

Attention is also directed to my earlier U.S. Pat. Nos. 3,312,205 issued Apr. 1967, and 2,966,900 issued Jan. 3, 1961, which disclose other forms of prior two-stroke internal combustion engines.

SUMMARY OF THE INVENTION

The invention provides an internal combustion engine comprising a combustion chamber, a piston movable relative to the combustion chamber between top dead center and bottom dead center positions and relative to first, second, and third positions relatively spaced from top dead center position at respectively greater distances, a source of fuel at a relatively high pressure, a transfer chamber, means for supplying air unmixed with fuel to the transfer chamber during piston travel between top dead center position and the first position, means providing communication between the transfer chamber and the combustion chamber during piston travel between the second position and bottom dead center position, means providing communication between the transfer chamber and the source of fuel during piston travel between the third position and bottom dead center position, whereby air is introduced into the transfer chamber during piston movement between top dead center position and the first position, whereby the air introduced into the transfer chamber is isolated during piston movement between the first and second positions, whereby the air introduced into the transfer chamber is subsequently permitted to flow into the combustion chamber from the transfer chamber during piston movement from the second position toward bottom dead center position, and whereby fuel is permitted to flow into the combustion chamber through the transfer chamber from the fuel source during piston movement from the third position toward bottom dead center position.

In accordance with one embodiment of the invention, the internal combustion engine comprises a combustion chamber, a piston movable relative to the combustion chamber between top dead center and bottom dead center positions and relative to first, second, and third positions relatively spaced from top dead center position at respectively greater distances, a source of relatively low pressure, a source of fuel/air mixture at a pressure higher than the low pressure, a transfer chamber, means providing communication between the transfer chamber and the low pressure source during piston travel between top dead center position and the first position, means providing communication between the transfer chamber and the combustion chamber during piston travel between the second position and bottom dead center position, means providing communication between the transfer chamber and the source of fuel/air mixture during piston travel between the third position and bottom dead center position and means for supplying air unmixed with fuel to the transfer chamber when the transfer chamber is subject to low pressure whereby, air is introduced into the transfer chamber in response to communication of the transfer chamber with the low pressure source during piston movement between top dead center position and the first position, whereby the air introduced into the transfer chamber is isolated during piston movement between the first and second positions, whereby the air introduced into the transfer chamber is subsequently permitted to flow into the combustion chamber from the transfer chamber during piston movement from the second position toward bottom dead center position and whereby fuel/air mixture is permitted to flow into the combustion chamber through the transfer chamber from the fuel/air mixture source during piston movement from the third position toward bottom dead center position.

In accordance with another embodiment of the invention, the internal combustion engine comprises a piston movable relative to a cylinder and a connected crankcase between top dead center and bottom dead center positions and relative to first, second and third positions respectively spaced from top dead center position at respectively greater distances, whereby the crankcase is subject to cyclical conditions of relatively high and low pressure, a transfer chamber, means for supplying fresh air to the transfer chamber when the transfer chamber is subject to low pressure, means for supplying a fuel/air mixture to the crankcase when the crankcase is subject to low pressure, means providing communication between the transfer chamber and the crankcase during conditions of low pressure in the crankcase and during piston travel between top dead center position and the first position whereby to cause introduction into the transfer chamber of fresh air, means for isolating the air introduced into the transfer chamber during piston movement between the first and second positions, means providing communication between the transfer chamber and the cylinder during piston travel between the second position and bottom dead center, whereby the air introduced into the transfer chamber flows from the transfer chamber into the cylinder, and means providing communication between the transfer chamber and the crankcase during conditions of relatively high pressure in the crankcase and during piston travel between the third position and bottom dead center position, whereby fuel/air mixture flows into the cylinder through the transfer chamber from the crankcase.

In accordance with one embodiment of the invention, the transfer chamber extends peripherally about the cylinder and includes spaced ends and the means communicating between the transfer chamber and the crankcase includes a transfer port communicating between the transfer chamber and the crankcase intermediate the ends of the transfer chamber.

In further accordance with an embodiment of the invention, the means for supplying fresh air includes, adjacent to each of the ends of the transfer chamber, a port communicating with the atmosphere and with the transfer chamber, and a reed valve in operable relation to the port.

In further accordance with one embodiment of the invention, the means providing communication between the transfer chamber and the crankcase during conditions of relatively high pressure in the crankcase comprises a transfer port communicating between the transfer chamber and the crankcase and a port in the piston registering with the transfer port.

The invention also provides a method of operating an internal combustion engine including a piston movable relative to a combustion chamber between top dead center and bottom dead center positions and relative to first, second, and third positions respectively spaced from top dead center position at respectively greater distances, a source of fuel at a relatively high pressure, a transfer chamber, and means for supplying fresh air to the transfer chamber, which method includes the steps of supplying fresh air to the transfer chamber during piston travel between top dead center position and the first position, thereafter isolating the air introduced into the transfer chamber during piston movement between the first and second positions, subsequently establishing communication between the transfer chamber and the combustion chamber during piston travel between the second position and bottom dead center position so as to permit flow of the air supplied to the transfer chamber into the combustion chamber frm the transfer chamber, and thereafter establishing communication between the transfer chamber and the source of fuel during piston travel between the third position and bottom dead center position so as to permit flow of fuel into the combustion chamber through the transfer chamber from the fuel source.

In one embodiment in accordance with the invention, there is provided a method of operating an internal combustion engine including a piston movable relative to a combustion chamber between top dead center and bottom dead center positions and relative to first, second, and third positions respectively spaced from top dead center position at respectively greater distances, a source of low pressure, a source of fuel/air mixture at a pressure higher than the low pressure, a transfer chamber, and means for supplying fresh air to the transfer chamber when the transfer chamber is subject to low pressure, which method includes the steps of establishing communication between the transfer chamber and the low pressure source during piston travel between top dead center position and the first position so as to cause introduction of fresh air into the transfer chamber from the fresh air supply means, thereafter discontinuing communication between the transfer chamber and the low pressure source to thereby isolate the air introduced into the transfer chamber during piston movement between the first and second positions, subsequently establishing communication between the transfer chamber and the combustion chamber during piston travel between the second position and bottom dead center position so as to permit flow of the air introduced into the transfer chamber into the combustion chamber from the transfer chamber, and thereafter establishing communication between the transfer chamber and the source of fuel/air mixture during piston travel between the third position and bottom dead center position so as to permit flow of fuel/air mixture into the combustion chamber through said transfer chamber from the fuel/air mixture source.

In one embodiment in accordance with the invention, there is provided a method of operating a two-stroke internal combustion engine including a piston movable relative to a cylinder and a connected crankcase between top dead center and bottom dead center positions and relative to first, second, and third positions respectively spaced from top dead center position at respectively greater distances, whereby the crankcase is subject to cyclical conditions of relatively high and low pressure, means for supplying fuel/air mixture to the crankcase when the crankcase is subject to low pressure, a transfer chamber, and means for supplying fresh air to the transfer chamber when the transfer chamber is subject to low pressure, said method including the steps of establishing communication between the transfer chamber and the crankcase during conditions of low pressure in the crankcase and during piston travel between top dead center position and the first position so as to cause introduction of fresh air into the transfer chamber from the fresh air supply means, thereafter isolating the air introduced into the transfer chamber during piston movement between the first and second positions, subsequently establishing communication between the transfer chamber and the cylinder during piston travel between the second position and bottom dead center position so as to permit flow of the air introduced into the transfer chamber into the cylinder from the transfer chamber, and thereafter establishing communication between the transfer chamber and the crankcase during conditions of high pressure and piston travel between the third position and bottom dead center position so as to obtain flow of fuel/air mixture into the cylinder through the transfer chamber from the crankcase.

One of the principal features of the invention is the provision of an internal combustion engine and a method of operating an internal combustion engine so as to obtain increased fuel economy and to reduce pollution.

Another of the principal provisions of the invention is the provision of a two-stroke internal combustion engine and a method of operation of such an engine so as to obtain increased fuel economy and to reduce pollution.

Another of the principal features of the invention is the provision of a two-stroke internal combustion engine and method of operation thereof which provides the dual advantages of reducing pollution and increasing horsepower output.

Still another of the principal features of the invention is the provision of a method of operating an internal combustion engine including the step of isolating a supply of fresh air in a transfer chamber, subsequently communicating the transfer chamber first to the combustion chamber and then to a source of fuel/air mixture under pressure while the transfer chamber is still in communication with the combustion chamber.

Another of the principal features of the invention is the provision of a method of operating a two-stroke internal combustion engine by communicating a transfer chamber to a crankcase when the crankcase is subject to relatively low pressure and thereby to cause an inflow of fresh air from the atmosphere into the transfer chamber and draw-back into the crankcase of fuel/air mixture in the transfer chamber (and, in some cases of fresh air), thereafter isolating the air in the transfer chamber, thereafter communicating the transfer chamber with the cylinder so as to assist scavaging by the air in the transfer chamber, and thereafter to communicate the transfer chamber with the crankcase during a condition of high pressure in the crankcase and while the transfer chamber is in communication with the cylinder so as to obtain flow of fuel/air mixture from the crankcase, through the transfer chamber, and into the cylinder Another of the principal features of the invention is the provision of an internal combustion engine in which fresh air is introduced into a transfer chamber and thereafter isolated, in which the transfer chamber is thereafter communicated with the combustion chamber so as to facilitate scavaging of the exhaust gases by the fresh air, and in which the transfer chamber is thereafter communicated with a source of fuel/air mixture under pressure and during the continuation of the communication of the transfer chamber with the combustion chamber so as to obtain fuel flow from the fuel/air mixture source through the transfer chamber and into the combustion chamber.

Still another of the principal features of the invention is the provision of a two-stroke internal combustion engine in which there is provided a transfer chamber including means for supplying fresh air to the transfer chamber during conditions of low pressure therein, wherein the transfer chamber is communicated with the crankcase during conditions of low pressure therein so as to subject the transfer chamber to low pressure and to thereby cause inflow of fresh air into the transfer chamber (and draw-back of fuel/air mixture from the transfer chamber into the crankcase), in which the fresh air in the transfer chamber is thereafter isolated, in which communication is thereafter established between the transfer chamber and the cylinder to facilitate scavaging of the exhaust gases from the cylinder by the fresh air in the transfer chamber, and in which communication is thereafter established between the transfer chamber and the crankcase during conditions therein of high pressure and during continued communication of the transfer chamber with the cylinder so as to obtain flow of the fuel/air mixture from the crankcase through the transfer chamber and into the cylinder.

Other features and advantages of the embodiments of the invention will become known by reference to the following general description, claims, and appended drawings.

THE DRAWINGS

Figure 2:
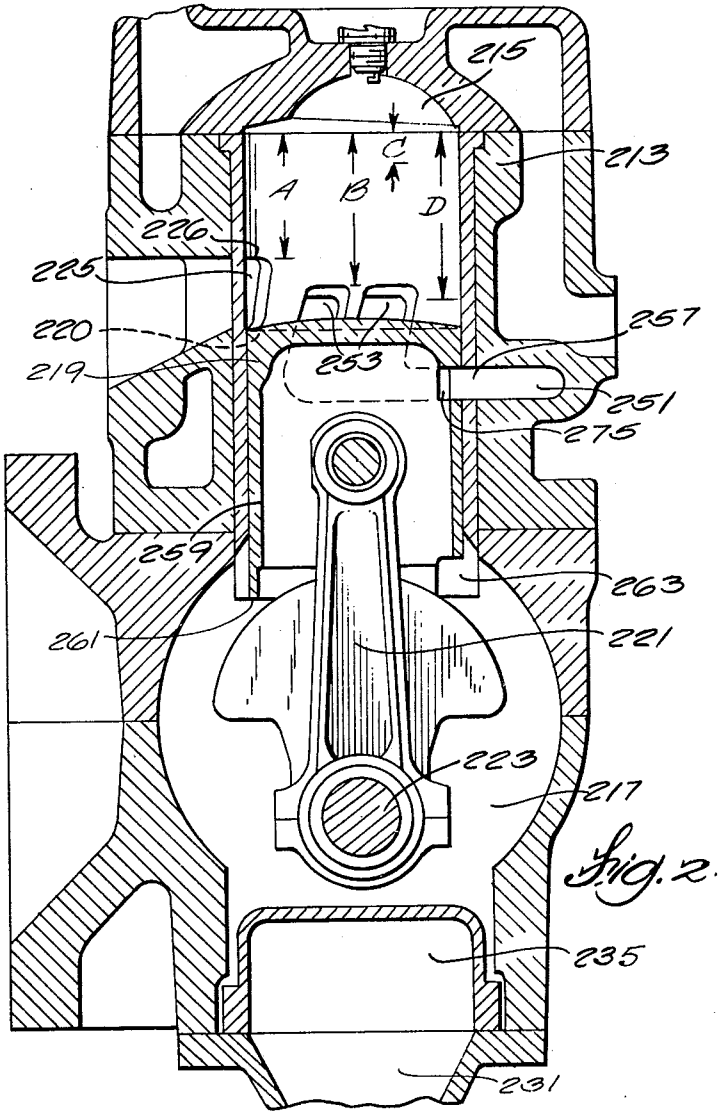
FIG. 2 is a sectional view, taken generally along line 2—2 of FIG. 1.
Figure 1:
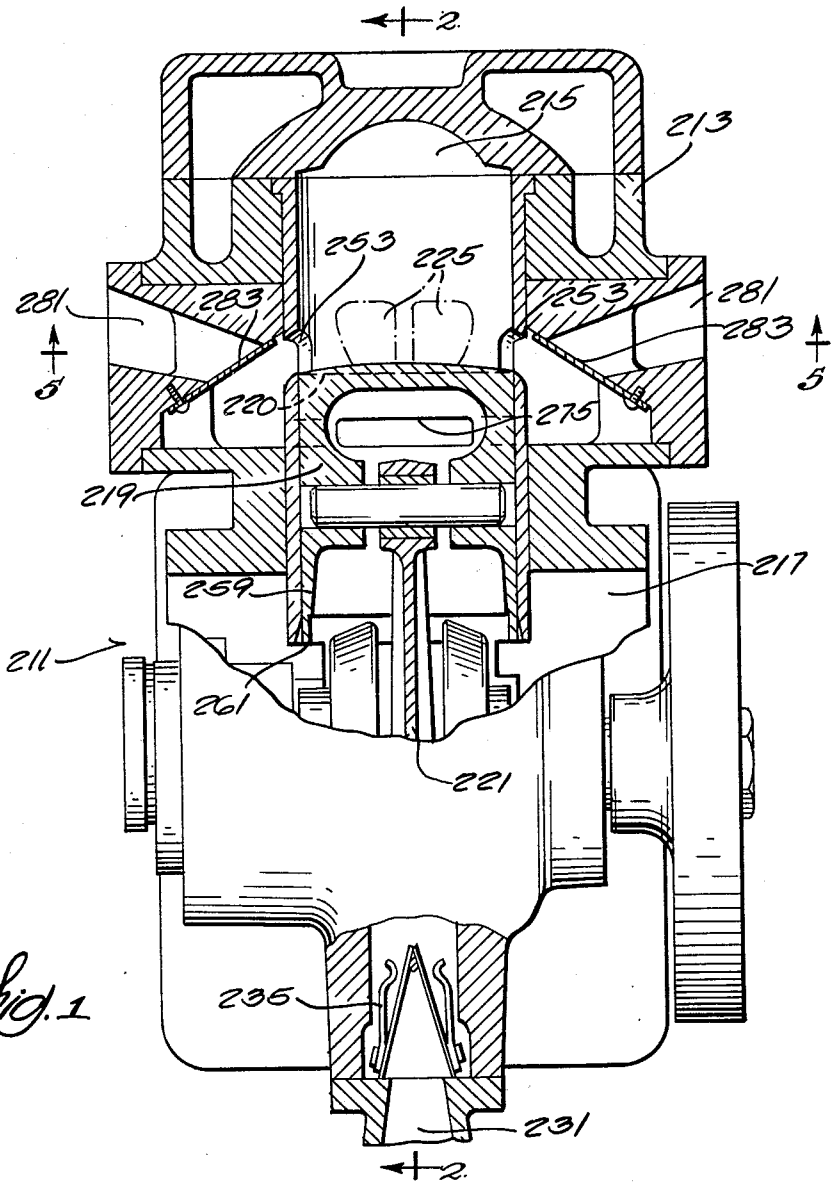
FIG. 1 is an elevational view, partially broken away and in section, of an internal combustion engine which embodies various of the features of the invention and which is illustrated with the piston at bottom dead center.

Before explaining one of the embodiments of the invention is detail, it is to be understood that the invention is not limited in its application to the details of construction and to the arrangement of the components set forth in the following description or illustrated in the drawings. The invention is capable of other embodiments of being practiced and carried out in various ways. Also, it is to be understood that the phraseology and terminology employed herein is for the purpose of description and should not be regarded as limiting.

GENERAL DESCRIPTION

Shown in the drawings is an internal combustion engine 211 which incorporates various of the features of the invention. More specifically, the engine 211 is a piston-ported two-stroke engine and includes a block 213 defining a combustion chamber 215 in the form of a cylinder, and a crankcase 217 extending from the combustion chamber 215. Reciprocably movable in the combustion chamber 215 and relative to the crankcase 217 is a piston 219 which cyclically produces conditions of relatively high and low pressures in the combustion chamber 215 and in the crankcase 217 incident to such reciprocation.

The piston 219 includes a head end 220 and is connected in the usual way to a connecting rod 221 which, in turn, is connected to a crankshaft 223 extending through the crankcase 217.

In accordance with usual practice, the combustion chamber 215 communicates with an exhaust port 225 which extends through the block 213 and includes an upper edge 26 spaced from the cylinder head end 220 at a distance A (See FIG. 2) such that the exhaust port 225 is opened as the piston 219 travels from top dead center to bottom dead center, commencing when the head end 220 of the piston 219 is located at the distance A from top dead center.

Figure 5:
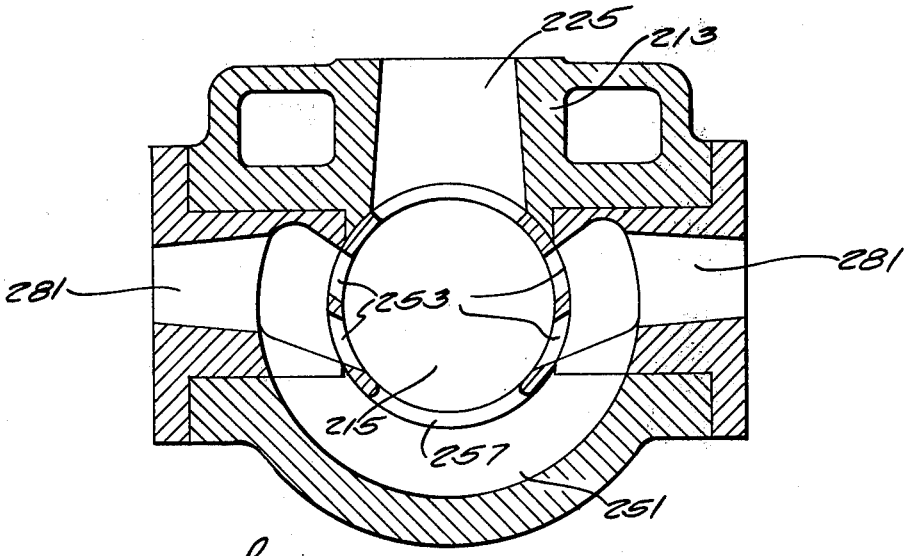
FIG. 5 is a sectional view taken along line 5—5 of FIG. 1 with parts omitted for the sake of clarity.

Included in the engine 211 is a transfer cavity for chamber 251 which preferably extends arcuately and horizontally around the cylinder as shown in FIG. 5.

Means are provided for establishing communication between the transfer chamber 251 and the cylinder 215 during piston movement between bottom dead center and a position spaced above bottom dead center at a location in which the head end 220 of the piston 219 is spaced from top dead center at a distance B greater than the distance A. (See FIG. 2) In the illustrated construction, such means comprises one or more inlet ports located adjacent each end of the transfer chamber 251 and communicating, in response to piston movement, with the cylinder 215.

Means are also provided for establishing communication between the transfer chamber 251 and a source of relatively low pressure during piston movement between top dead center and a position in which the head end 220 of the piston 219 is spaced from top dead center that a distance C (See FIG. 2) which is less than the distance A. In the illustrated construction, the low pressure source comprises the crankcase 217 and communication is established by reason of registration of a transfer port 257 which extends in the engine block 213 from the mid part of the transfer chamber 251 and which is exposed to the crankcase 217 when the piston 219 is traveling between top dead center and the piston position located at the distance C from top dead center. In the specifically illustrated construction, the piston 219 has a skirt 259 with a lower edge 261 provided with a notch or cutout 263 which registers with the transfer port 257 to afford communication between the transfer chamber 251 and the crankcase 217 at the desired time.

Figure 4:
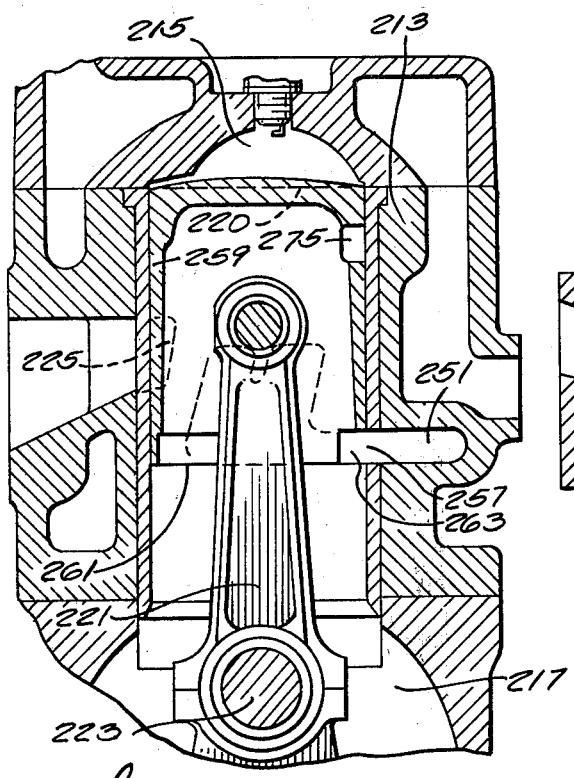
FIG. 4 is a fragmentary view, in section, of a portion of the engine shown in FIG. 1 and in which the piston is shown in another operating position.
Figure 3:
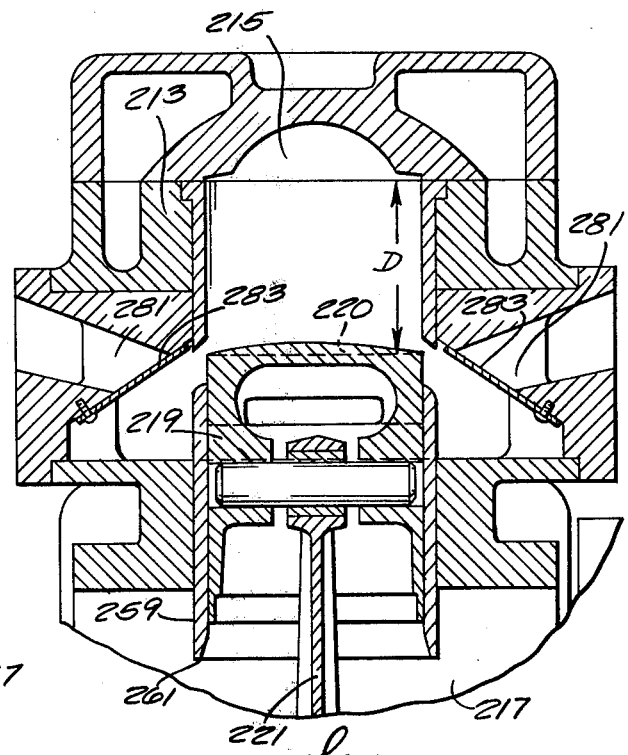
FIG. 3 is a fragmentary view, in section, of a portion of the engine shown in FIG. 1 and showing the piston in top dead center position.

Means are also provided for establishing communication between the transfer chamber 251 and a source of fuel/air mixture at a pressure higher than the low pressure during piston movement between bottom dead center and a position in which the head end 220 of the piston 219 is spaced above bottom dead center at a distance D from top dead center (See FIG. 2 and FIG. 4) which is greater than the distance B. In the illustrated construction, the source of fuel/air mixture at a pressure higher than the low pressure comprises the crankcase 217 and the communication is established between the crankcase 217 and the transfer chamber 251 by registration of the transfer port 257 and a port 275 which is formed in the skirt 257 of the piston 219 to afford communication between the transfer chamber 251 and the crankcase 217 during the desired period. Accordingly, when communication is established between the transfer chamber 251 and the crankcase 217, the transfer port 257 and piston port 275 register and fuel/air mixture flows from the crankcase 217 through the transfer chamber 251 and into the cylinder 215.

The means for supplying a fuel/air mixture at a relatively high pressure to the transfer cavity of chamber 251 also includes, in the illustrated construction, supply of a fuel/air mixture to the crankcase 217 through a carburetor 231 and reed valve arragement 234. Other constructions could be employed.

Means are also provided for supplying fresh air unmixed with fuel to the transfer chamber 215 when the transfer chamber 251 is subject to low pressure, i.e., during communication of the transfer chamber 251 with the low pressure source which, in the illustrated construction, is provided by the crankcase 217. In the disclosed construction, such means comprises, at each end of the transfer chamber 251, an air entry port 281 and a reed valve 283 which opens in response to low pressure in the transfer chamber 251 to afford inflow of fresh air and which closes during conditions of relatively high pressure in the transfer chamber 251 so as to isolate the air in the transfer chamber 251.

Means are provided for isolating the air introduced into the transfer chamber 251 during piston movement between the locations or positions C and B. Such means includes the reed valves 283 and the piston skirt 259 which closes the inlet and transfer ports 253 and 257 during movement between the locations or positions B and C of the piston 219. Such isolation prevents flow into the cylinder 215 from the transfer chamber 251 during piston movement between top dead center and the location B and prevents inter mixture between the air in the transfer chamber 251 and the fuel/air mixture in the crankcase 217 during pressurization of the fuel/air mixture in the crankcase 217 as the piston 219 travels between the locations or positions D and C.

In operation, when the piston 219 is adjacent to top dead center, the low pressure in the crankcase 217 is communicated through the transfer port 257 to the transfer chamber 251, causing a low pressure in the transfer chamber so as thereby to cause simultaneous inflow of fresh air into both ends of the transfer chamber 251 through the air entry ports 281 and draw-back or withdrawal through the transfer port 257 and into the crankcase 217 and any fuel/air mixture remaining in the transfer chamber 251 at the time of closing of the inlet ports 253 during the previous compression stroke.

When the head end 220 of the piston 219 is located between the locations C and B, the air introduced into the transfer chamber 251 is isolated. During isolation, the air trapped in the transfer chamber 251 is heated and therefore is elevated somewhat in pressure.

During the movement of the piston 219 from top dead center, the exhaust port 225 is next initially opened when the piston passes through the position located at the distance A from top dead center. Thereafter as the piston 219 continues to move downwardly, the piston 219 uncovers the inlet ports 253 to initiate communication between the cylinder 215 and the transfer chamber 251. Initially it is believed that pressure in the cylinder 215 is greater than the somewhat elevated pressure in the transfer chamber 251. Thus, it is believed that, initially, the exhaust gas additionally pressurizes the air trapped in the transfer chamber 251. However, as exhaust continues, the previously trapped and pressurized air subsequently flows from the transfer chamber 251 into the cylinder 215 and through the cylinder 215 to assist in evacuation of the burnt products of combustion.

As the piston 219 continues its downward travel toward bottom dead center, communication is thereafter established between the transfer chamber 251 and the relatively highly pressurized fuel or fuel/air mixture in the crankcase 217. Such communication causes flow of fuel or fuel/air mixture through the transfer chamber 251 and into the cylinder 215 after scavaging by the previously trapped air is substantially or completely completed.

Thus, the air which is initially introduced into the transfer chamber 251 and thereafter isolated and increased in pressure, is employed for scavaging, thereby avoiding use of and reducing loss of fuel through the exhaust so as to obtain increased fuel economy and a cleaner exhaust. In addition, and depending upon the operating conditions and the dimensions of the components, the air employed to scavenge the cylinder 215 can also be used to ignite unburned combustibles in the exhaust system and thereby to produce an engine with a cleaner emission.

While the illustrated construction is piston-ported, other arrangements can be employed to provide the desired communication at the desired times. For instance, a camshaft operated valve system could be employed. Alternatively, a rotary valve could be employed to provide the various sequential communications.

In addition, means other than the disclosed crankcase can be provided for supplying a source of low pressure and a source of fuel or fuel/air mixture at a pressure higher than low pressure. For instance, a separate low pressure source and a separate fuel or fuel/air mixture source could be employed.

In this last regard, instead of a crankcase, a stepped piston arrangement could be employed to provide either or both of the low pressure source and the source of fuel or fuel/air mixture at a pressure higher than low pressure. Alternatively, a blower could be employed to provide the source of fuel or fuel/air mixture at a pressure higher than low pressure.

In addition, the means for supplying fresh air to the transfer chamber 251 can include a blower (not shown) for delivering air into the transfer chamber 251 as distinguished from reliance on low pressure to induce air flow into the transfer chamber 251. Thus, alternate source of relatively high and low pressure are employed, with the high pressure serving to cause flow through the transfer chamber 251 and into the cylinder of fuel or fuel/air mixture and with the low pressure serving to induce or to assist flow into the transfer chamber 251 of fresh air unmixed with fuel.

In the illustrated construction, the reed valve arrangement 235 controlling supply of fuel/air mixture into the crankcase 217 from the carburetor 231 is relatively heavy so that the reed valves 283 controlling supply of fresh air into the transfer chamber 251 will open, in response to decreasing pressures, before the reed valve arrangement 235 supplying fuel/air mixture to the crankcase 217.

Preferably, the distance between opening of the inlet port 253 and establishment of communication between the transfer chamber 251 and the crankcase 217, as measured by degrees of crankshaft rotation, is to be maximized to the degree permissible, consistent with adequate exhaust and ample opportunity for supply of fuel/air mixture. In the illustrated construction, approximately 20 degrees of crankshaft rotation occurs between opening of the inlet 253 and the establishment of communication between the crankcase 217 and the transfer chamber 251.

The isolation of the air introduced into the transfer chamber 251 prevents mixture thereof with the fuel/air mixture until establishment of communication between the crankcase 217 and the transfer chamber 251. Prior to said establishment, the air is permitted to flow into the cylinder 215 for scavening thereof, thereby to prevent waste of fuel/air mixture during scavaging.

If desired, all of the air employed both for scavening and for mixing with the fuel can be initially introduced into and through the transfer chamber 251 and hence into the crankcase 217 and fuel can be separately injected into the crankcase 217 after isolation of the transfer chamber 251 so as thereby to provide the fuel/air mixture which will later be supplied to the transfer chamber 251 and into the cylinder 215.

It is believed that the method of the invention is clearly apparent from the foregoing description of the operation of the engine 211.

The invention has general applicability to spark ignition piston-ported engines, i.e., piston-ported engines other than diesel piston-ported engines and is equally applicable to cross scavenged and loop scavenged engines.

Various of the features of the invention are set forth in the following claims.

What is claimed is:

1. A method of operating an internal combustion engine including a combustion chamber, a piston movable relative to the combustion chamber between top dead center and bottom dead center positions and relative to first, second, and third positions respectively spaced from top dead center position at respectively greater distances, a source of fuel at a relatively high pressure, a transfer chamber, and means for supplying fresh air to the transfer chamber, said method including the steps of supplying fresh air to the transfer chamber during piston travel between top dead center position and the first position, thereafter isolating the air introduced into the transfer chamber during piston movement from the first position to the second position, subsequently establishing communication between the transfer chamber and the combustion chamber during piston travel between the second position and bottom dead center position so as to permit flow of the air supplied to the transfer chamber into the combustion chamber from the transfer chamber, and thereafter establishing communication between the transfer chamber and the source of fuel during piston travel between the third position and bottom dead center position so as to permit flow of fuel into the combustion chamber through the transfer chamber from the fuel source.

2. A method in accordance with claim 1 including the additional step of elevating the pressure of the air isolated in the transfer chamber.

3. A method of operating an internal combustion engine including a combustion chamber, a piston movable relative to the combustion chamber between top dead center and bottom dead center positions and relative to first, second, and third positions respectively spaced from top dead center positon at respectively greater distances, a source of low pressure, a source of fuel/air mixture at a pressure higher than the low pressure, a transfer chamber, and means for supplying fresh air to the transfer chamber when the transfer chamber is subject to low pressure, said method including the steps of establishing communication between the transfer chamber and the low pressure source during piston travel between top dead center position and the first position so as to cause introduction of fresh air into the transfer chamber from the fresh air supply means, thereafter isolating the air introduced into the transfer chamber during piston movement from the first position to the second position, subsequently establishing communication between the transfer chamber and the combustion chamber during piston travel between the second position and bottom dead center position so as to permit flow of the air introduced into the transfer chamber into the combustion chamber from the transfer chamber, and thereafter establishing communication between the transfer chamber and the source of fuel/air mixture during piston travel between the third position and bottom dead center position so as to permit flow of fuel/air mixture into the combustion chamber through the transfer chamber from the fuel/air mixture source

4. A method of operating a two-stroke internal combustion engine including a cylinder extending from a crankcase, a piston movable relative to the cylinder between top dead center and bottom dead center positions and relative to first, second, and third positions respectively spaced from top dead center position at respectively greater distances, whereby the crankcase is subject to cyclical conditions of relatively high and low pressure, means for supplying fuel/air mixture to the crankcase when the crankcase is subject to low pressure, a transfer chamber, and means for supplying fresh air to the transfer chamber when the transfer chamber is subject to low pressure, said method including the steps of establishing communication between the transfer chamber and the crankcase during conditions of low pressure in the crankcase and during piston travel between top dead center postion and the first position so as to cause introduction of fresh air into the transfer chamber from the fresh air supply means, thereafter isolating the air introduced into the transfer chamber during piston movement from the first position to the second position, subsequently establishing communication between the transfer chamber and the cylinder during piston travel between the second position and bottom dead center position so as to permit flow of the air introduced into the transfer chamber into the cylinder from the transfer chamber, and thereafter establishing communication between the transfer chamber and the crankcase during conditions of high pressure in the crankcase and piston travel between the third position and bottom dead center position so as to obtain flow of fuel/air mixture into the cylinder throughthe transfer chamber from the crankcase.

5. An internal combustion engine comprising a combustion chamber, a piston movable relative to said combustion chamber between top dead center and bottom dead center positions and relative to first, second, and third positions relatively spaced from top dead center position at respectively greater distances, a source of fuel at a relatively high pressure, a transfer chamber, means for supplying air unmixed with fuel to said transfer chamber during piston travel between top dead center position and the first position, means for isolating the air in the transfer chamber during piston travel from the first position to the second position, means providing communication between said transfer chamber and said combustion chamber during piston travel between the second position and bottom dead center position, means providing communication between said transfer chamber and said source of fuel during piston travel between the third position and bottom dead center position, whereby air is introduced into said transfer chamber during piston movement between top dead center position and the first position, whereby the air introduced into said transfer chamber is isolated during piston movement from the first position to the second position, whereby air introduced into said transfer chamber is subsequently permitted to flow into said combustion chamber from said transfer chamber during piston movement for the second position toward bottom dead center position, and whereby fuel is permitted to flow into said combustion chamber through said transfer chamber from said fuel source during piston movement from the third position toward bottom dead center position.

6. An internal combustion engine comprising a combustion chamber, a piston movable relative to said combustion chamber between top dead center and bottom dead center positions and relative to first, second, and third positions relatively spaced from top dead center positions at respectively greater distances, a source of relatively low pressure, a source of fuel/air mixture at a pressure higher than the low pressure, a transfer chamber, means providing communication between said transfer chamber and said low pressure source during piston travel between top dead center position and the first position, means for isolating the air in the transfer chamber during piston travel from the first position to the second position, means providing communication between said transfer chamber and said combustion during piston travel between the second position and bottom dead center position, means providing communication between said transfer chamber and said source of fuel/air mixture during piston travel between the third position and bottom dead center position, and means for supplying air unmixed with fuel to said transfer chamber when said transfer chamber is subject to low pressure, whereby air is introduced into said transfer chamber in response to communication of said transfer chamber with said low pressure source during piston movement between top dead center position and the first position, whereby the air introduced into said transfer chamber is isolated during piston movement from the first position to the second position, whereby the air introduced into the transfer chamber subsequently flows into said combustion chamber from said transfer chamber during piston movement between the second position and bottom dead center position, and whereby fuel/air mixture flows into said combustion chamber through said transfer chamber from said fuel/air mixture source during piston movement between the third position and bottom dead center position.

7. A two-stroke internal combustion engine comprising a cylinder, a crankcase extending from said cylinder, a piston movable relative to said cylinder and said crankcase between top dead center and bottom dead center positions and relative to first second and third positions respectively spaced from top dead center position at respectively greater distances, whereby said crankcase is subject to cyclical conditions of relatively high and low pressure, a transfer chamber, means for supplying fresh air to said transfer chamber when said transfer chamber is subject to low pressure, means for supplying a fuel/air mixture to said crankcase when said crankcase is subject to low pressure, means providing communication between said transfer chamber and said crankcase during conditions of low pressure in said crankcase and during piston travel between top dead center position and the first position whereby to cause introduction into said transfer chamber of fresh air, means for isolating the air introduced into said transfer chamber during piston movement from the first position to the second position, means providing communication between said transfer chamber and said cylinder during piston travel between the second position and bottom dead center, whereby the air introduced into said transfer chamber flows from said transfer chamber into said cylinder, and means providing communication between said transfer chamber and said crankcase during conditions of relatively high pressure in said crankcase and during piston travel between the third position and bottom dead center position, whereby fuel/air mixture flows into said cylinder through said transfer chamber from said crankcase.

8. An internal combustion engine in accordance with claim 7 wherein said means for supplying fresh air to said transfer chamber comprises a port communicating between said transfer chamber and the atmosphere and a reed valve in operative relation to said port.

9. An internal combustion engine in accordance with claim 7 wherein said means for supplying a fuel/air mixture to said crankcase includes means for supplying fuel to said crankcase.

10. An internal combustion engine in accordance with claim 7 wherein said means for supplying a fuel/air mixture to said crankcase includes a carburetor.

11. An internal combustion engine in accordance with claim 7 wherein said means providing communication between said transfer chamber and said crankcase during piston travel between top dead center and the first position comprises a port communicating between said transfer chamber and said crankcase.

12. An internal combustion engine in accordance with claim 7 wherein said means providing communication between said transfer chamber and said crankcase during conditions of relatively high pressure in said crankcase comprises a transfer port communicating between said transfer chamber and said crankcase and a port in said piston registering with said transfer port.

13. An internal combustion engine in accordance with claim 7 wherein said transfer chamber extends peripherally about said cylinder and includes spaced ends and wherein said means communicating between said transfer chamber and said crankcase during conditions of low and high pressure in said crankcase include a common transfer port communicating between said transfer chamber and said crankcase intermediate said ends of said transfer chamber.

14. An internal combustion engine in accordance with claim 13 wherein said means for supplying fresh air includes, adjacent to each of said ends of said transfer chamber, a port communicating with the atmosphere and with said transfer chamber, and a reed valve in operable relation to said port.

15. An internal combustion engine in accordance with claim 7 wherein said means providing communication between said transfer chamber and said cylinder comprises a port.

16. A method of operating an internal combustion engine including a combustion chamber, a piston movable relative to the combustion chamber between top dead center and bottom dead center positions and relative to first and second positions respectively spaced from the top dead center position at respectively greater distances, a source of fuel at a relatively high pressure, a transfer chamber, and means for supplying fresh air to the transfer chamber, said method including the steps of supplying fresh air to the transfer chamber during piston travel between top dead center position and the first position, thereafter isolating the air introduced into the transfer chamber during piston movement from the first position to the second position, subsequently establishing communication between the transfer chamber and the combustion chamber during piston travel between the second position and bottom dead center position so as to permit flow of the air supplied to the transfer chamber into the combustion chamber from the transfer chamber and between the transfer chamber and the source of fuel during piston travel between the second position and bottom dead center position so as to permit flow of fuel into the combustion chamber through the transfer chamber from the fuel source after the flow of the air into the combustion chamber from the transfer chamber.

17. An internal combustion engine comprising a combustion chamber, a piston movable relative to said combustion chamber between top dead center and bottom dead center positions and relative to first and second positions relatively spaced from top dead center position at respectively greater distances, a source of fuel at a relatively high pressure, a transfer chamber, means for supplying air unmixed with fuel to said transfer chamber during piston travel between top dead center position and the first position, means for isolating the air in the transfer chamber during piston travel from the first position to the second position, means providing communication between said transfer chamber and said combustion chamber during piston travel between the second position and bottom dead center position, and means providing communication between said transfer chamber and said source of fuel during piston travel between the second position and bottom dead center position, whereby air is introduced into said transfer chamber during piston movement between top dead center position and the first position, whereby the air introduced into said tranfer chamber is isolated during piston movement from the first position to the second position, and whereby the air introduced into said transfer chamber is subsequently permitted to flow into said combustion chamber from said transfer chamber and fuel is thereafter permitted to flow into said combustion chamber through said transfer chamber from said fuel source during piston movement from the second position toward bottom dead center position.

* * * * *

UNITED STATES PATENT AND TRADEMARK OFFICE

CERTIFICATE OF CORRECTION

PATENT NO. : 4,067,302

DATED : January 10, 1978

INVENTOR(S) : Josef Ehrlich

It is certified that error appears in the above-identified patent and that said Letters Patent are hereby corrected as shown below:

| | |
|---|---|
| In the Abstract, line 13 | "transfor" should be ---transfer---. |
| Column 1, line 18 | "in" should be ---into---. |
| Column 3, line 46 | "frm" should be ---from---. |
| Column 6, line 14 | "is" should be ---in---. |
| Column 6, line 50 | "for" should be ---or---. |
| Column 7, line 37 | "of" should be ---or---. |
| Column 7, line 40 | "arragement" should be ---arrangement---. |
| Column 7, line 40 | "234" should be ---235---. |
| Column 8, line 9 | "and" should be ---of---. |
| Column 9, line 11 | "source" should be ---sources---. |
| Column 9, line 33 | after the word "inlet", insert the word ---ports---. |
| Column 11, line 15 | "throughthe" should be ---through the---. |

UNITED STATES PATENT AND TRADEMARK OFFICE

CERTIFICATE OF CORRECTION

PATENT NO. : 4,067,302

DATED : January 10, 1978

INVENTOR(S) : Josef Ehrlich

It is certified that error appears in the above-identified patent and that said Letters Patent are hereby corrected as shown below:

| | |
|---|---|
| Column 11, line 40 | after the word "whereby", insert the word ---the---. |
| Column 11, line 63 | after the word "combustion", insert the word ---chamber---. |
| Column 13, line 32 | after the word "from", delete "the". |

Signed and Sealed this

*Third* Day of *April 1979*

[SEAL]

*Attest:*

RUTH C. MASON
*Attesting Officer*

DONALD W. BANNER
*Commissioner of Patents and Trademarks*